US009472127B2

(12) United States Patent
Tatum

(10) Patent No.: US 9,472,127 B2
(45) Date of Patent: Oct. 18, 2016

(54) GALLERY DISPLAY APPARATUS

(71) Applicant: Barry Featherstun Tatum, Mechanicsville, VA (US)

(72) Inventor: Barry Featherstun Tatum, Mechanicsville, VA (US)

( * ) Notice: Subject to any disclaimer, the term of this patent is extended or adjusted under 35 U.S.C. 154(b) by 0 days.

(21) Appl. No.: 14/214,686

(22) Filed: Mar. 15, 2014

(65) Prior Publication Data

US 2014/0259839 A1 Sep. 18, 2014

Related U.S. Application Data

(60) Provisional application No. 61/783,912, filed on Mar. 14, 2013.

(51) Int. Cl.

| | |
|---|---|
| ***G09F 7/00*** | (2006.01) |
| ***G09F 7/08*** | (2006.01) |
| ***G09F 7/14*** | (2006.01) |
| ***G09F 7/18*** | (2006.01) |

(52) U.S. Cl.
CPC . *G09F 7/08* (2013.01); *G09F 7/14* (2013.01); *G09F 7/18* (2013.01); *G09F 2007/1852* (2013.01)

(58) Field of Classification Search
CPC ..... G09F 3/20; G09F 1/20; G09F 1/12; G09F 7/04; G09F 1/10; A47G 2001/0672; A47G 1/06; A47G 1/14
USPC ..... 40/654.01, 657, 775, 776
See application file for complete search history.

(56) References Cited

U.S. PATENT DOCUMENTS

| | | | | |
|---|---|---|---|---|
| 811,846 | A * | 2/1906 | Hidden | 40/118 |
| 3,207,421 | A * | 9/1965 | Hunger et al. | 229/72 |
| 3,795,071 | A * | 3/1974 | Wagner | 40/611.12 |
| 4,736,853 | A * | 4/1988 | O'Mara | 211/88.01 |
| 5,351,813 | A * | 10/1994 | Golovan | 220/483 |
| 5,375,352 | A * | 12/1994 | Morris | 40/737 |
| 5,460,305 | A * | 10/1995 | Ahearn | B60R 11/06 211/DIG. 1 |
| 5,547,077 | A * | 8/1996 | Wang | 206/307.1 |
| 5,813,539 | A * | 9/1998 | DePalma | 206/459.1 |
| D434,570 | S * | 12/2000 | Thorne et al. | D6/301 |
| 6,336,555 | B1 * | 1/2002 | Breeden | 206/371 |
| 6,349,491 | B1 * | 2/2002 | Able | 40/124.01 |
| 6,657,924 | B2 * | 12/2003 | McCravy | 368/28 |
| 6,694,650 | B2 * | 2/2004 | Brown | 40/124.2 |
| D544,542 | S * | 6/2007 | Carson | D19/59 |
| D583,867 | S * | 12/2008 | Powers et al. | D19/52 |
| 2001/0019206 | A1 * | 9/2001 | Deans | 281/2 |
| 2004/0050747 | A1 * | 3/2004 | Iso | 206/534 |
| 2005/0198882 | A1 * | 9/2005 | Zaremba | 40/654.01 |
| 2008/0222934 | A1 * | 9/2008 | Dworetz | 40/661 |
| 2013/0020210 | A1 * | 1/2013 | Bemboom et al. | 206/232 |

FOREIGN PATENT DOCUMENTS

JP 2000074551 A * 3/2000

* cited by examiner

*Primary Examiner* — Cassandra Davis
(74) *Attorney, Agent, or Firm* — Muncy, Geissler, Olds & Lowe, P.C.

(57) ABSTRACT

A magnetically-attachable display gallery provides a neat and decorative platform to easily add items such as greeting cards, photographs, and other documents by simply slipping them behind the snug clear vinyl pockets. The display gallery is constructed to roll or fold to store neatly away when not in use or for shipping.

2 Claims, 5 Drawing Sheets

GALLERY DISPLAY APPARATUS

CROSS-REFERENCE TO RELATED APPLICATIONS

This application claims the benefit of U.S. Provisional Application No. 61/783,912, filed Mar. 14, 2013.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND

1. Field

The invention relates to image display devices. In particular, the invention relates to such display devices that are removably secured to refrigerator doors or other paramagnetic surfaces.

2. Related Art

Photo holiday greeting cards have become very popular. During the holiday season, the typical household refrigerator door becomes cluttered with these cards, precariously held to the surface with an assortment of inadequate magnets. The eventual result is a disorganized mess, much of which ends up on the floor at the slightest touch or opening of the refrigerator door.

Currently, the most common solution for organizing and displaying photo cards is to place them under a refrigerator magnet as the cards are received. Commonly, the recipient runs out of magnets before the cards stop arriving and the individual magnets start being used to hold more than one card, ultimately creating a frustrating mess. Since the magnets are not designed to typically hold more than one item securely, using the magnet to hold two or more items is typically a temporary situation at best. Opening of the refrigerator door is more than likely to result in dislodging the magnet, causing the items to drop to the floor. Additionally, upon removing the items at the end of a season, one must secure additional storage to hold the items, including photos and cards, and, either leave the magnets on the refrigerator or store the magnets in another location.

Another alternative solution is the use of adhesive magnetic backing. This is a permanent treatment which is applied to individual items. This approach requires additional manual intervention, requires more effort by a user, depends on ready availability of a supply of the adhesive magnetic backing strips, fails to readily organize the cards and is expensive when dealing with multiple pieces.

A further solution is a multi-opening, collage-style frame that can be taken apart, filled with photos and then placed magnetically on the door of a refrigerator. This solution also requires a greater amount of effort, has a limited capacity, and is not adaptable to hold a range of items with different sizes. Another drawback is that one must have all photos on hand when the frame is being filled. Otherwise, as each photo is added, the frame must be disassembled, the photo added and positioned, other photos repositioned, and then the frame is reassembled. Frequently, it is necessary to hold each photo in position using tape or other adhesive before assembling the frame. Further, the frame size is fixed and cannot be folded or rolled for easier compact storage. Additionally, the weight of the frame itself, even when not filled with photos or cards, can be substantial. This additional weight may require significantly larger magnets to hold the frame on the refrigerator door. Still further, the filled frame is more likely to dislodge whenever opening or closing the refrigerator door due to the additional weight. Once dislodged, the frame is likely to fall to the floor and be damaged, preventing further use.

A wide variety of holding apparatus that are attachable to some type of vertical surface, such as a refrigerator door or the like, are known. However, those known lack a configuration readily suitable for application to the refrigerator door and then subsequent storage. In addition, those known do not provide a gallery effect that continually provides a streamlined organized look during the entire time the display is being filled with items.

For example, U.S. Pat. No. 3,797,146 to Holes discloses an album with multiple album pages having rectangular transparent strips to form upwardly opening pockets to hold photos. However, the invention of Holes is not adaptable for ready attachment to a refrigerator door, does not provide an open display readily visible for viewing, and instead requires that one open and page through the album.

U.S. Pat. No. 5,351,813 to Golovan discloses a holding apparatus for relatively small items for attachment to a vertical surface such as a refrigerator door. The disclosure of Golovan is designed to provide attachable compartments for holding a plurality of different items and thus, is not intended to provide an aesthetically pleasing display while it is being filled with items.

U.S. Pat. No. 5,916,650 to Grant discloses another method for displaying a photograph or other item next a surface such as a refrigerator door wherein the holding mechanism is a resilient monolithic plastic sheet display cover which is removably adherent to the surface chosen. Grant's display cover and method is generally intended to support only one photo rather than a plurality.

U.S. Pat. No. 6,578,304 to Grant discloses a magnetic frame for displaying an object such as a photograph or other item on magnetically attractive surfaces, such as a refrigerator, cabinet or the like. The disclosure of Grant only addresses the display of a single photo and requires a separate envelope for enclosure of the photo wherein the envelope includes a flat magnetic sheet that is used to adhere the image and envelope to the surface.

U.S. patent application Ser. No. 12/369,750 to Lapesky et al describes a magnetic photo gallery comprised of two separate magnetic sheets to display a collage of photographs. Each photograph is sandwiched between the magnetic sheets and cannot be easily removed without disturbing the remainder of the photos encased between the magnetic sheets. The invention of Lapesky does not allow one photo to be removed at a time. Additionally, the invention of Lapesky discloses a constrained set of frames that would preclude organizing photos in a plurality of different ways.

Consequently, there exists a substantial unmet need for a display solution that is inexpensive and easily accessible to serve as a neat and decorative platform to receive and display photos, cards and other paper documents as they arrive throughout a season. There exists a further need for such a platform to be constructed to roll or fold to store neatly away when not in use. It would be desirable for the existing photos, cards or items to likewise be stored with the platform when the platform is folded or rolled for storage. There exists a further need for the platform to provide a large surface area for displaying cards, photos and other items yet still be easily applied and easily removed from the mounting surface, e.g., a refrigerator door. There exists a further need for the platform to accept a multitude of various sized and shaped inserts while still maintaining a secure, organized, and streamlined appearance. There exists a further need for the platform to allow the insertion or removal of one or more photos or items without disturbing the position of the remainder of the items. There exists a further need for a platform to allow a plurality of photos or items to be compressed within the holding area of the platform as the number of photos or cards received increases. There exists a further need for the platform to have the ability to adhere to other nonmagnetic surfaces such as office cubicle walls while maintaining the same functionality as the magnetic version.

BRIEF SUMMARY

In view of the foregoing described needs, an embodiment of the present invention includes a clean, streamlined planar but foldable or rollable surface for displaying items, typically on the door of a refrigerator. The front of the planar surface may be decorated with a seasonal-themed pattern, a holiday image, or other image or design under rows of horizontal and/or vertical clear vinyl pockets. The pockets are sized to readily receive and neatly display photos, cards and other items, particularly as they arrive each day throughout a season. A season may be a school year, a holiday season or other desired period tending to memorialize events or people. The gallery display apparatus may be rolled or folded to store neatly away when not in use. Non-seasonal variations are suitable for everyday organization of cards, photographs, and documents. Other versions of the gallery display apparatus can be attached on walls and other non-metallic surfaces without relying on magnetic attachment means.

BRIEF DESCRIPTION OF THE DRAWINGS

For a more complete understanding of the present invention, reference is made to the detailed description contained herein and the accompanying drawings numbered below which are given by way of illustration only and are not intended to be limitative to any extent. Commonly used reference numbers identify the same or equivalent parts of the claimed invention throughout the several figures. Now, therefore:

DETAILED DESCRIPTION

The following description is merely exemplary in nature and is in no way intended to limit the invention, its application, or its uses. Following is a description of an exemplary embodiment of a display gallery apparatus according to the invention.

Figure 1A:
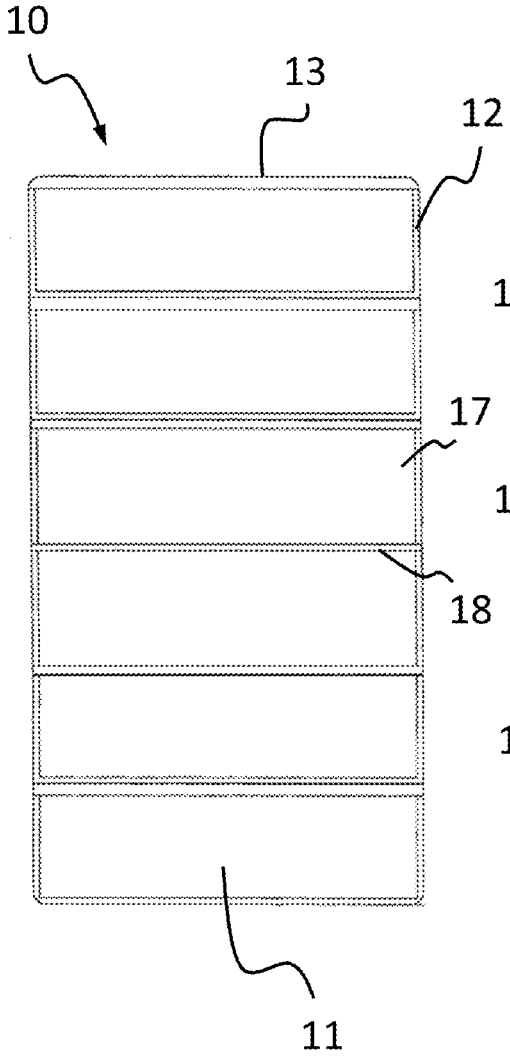
FIGS. 1A and 1B are front and back elevation views, respectively of the gallery display apparatus.
Figure 1B:
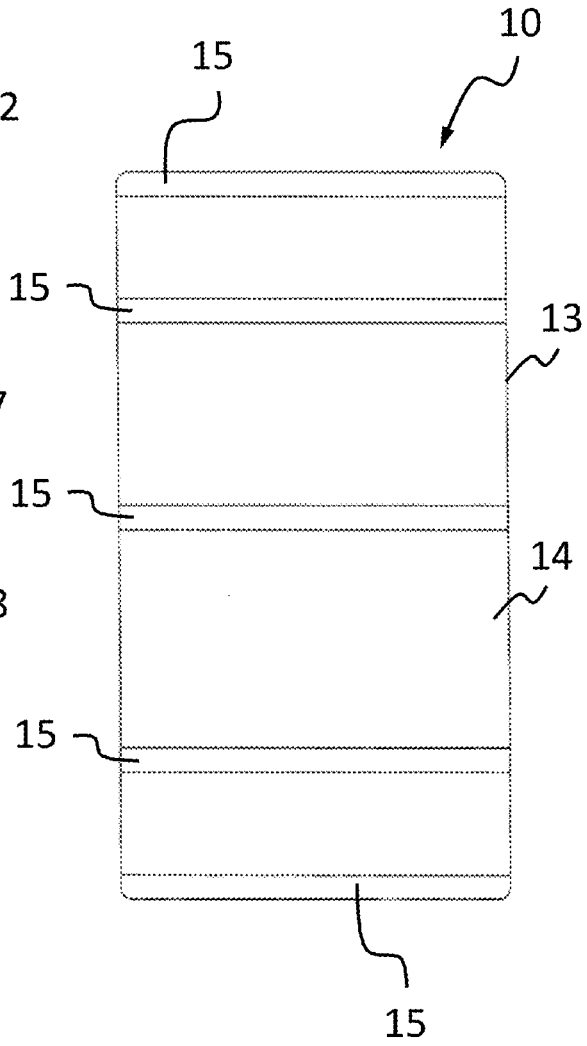

As illustrated in FIG. 1A and FIG. 1B, a display gallery apparatus 10 is used to provide a neat, flexible, adaptable and decorative platform to easily insert and display greeting cards, photographs, photo cards, postcards, and other documents and items by slidably inserting them behind clear pockets 11 and against a backing 13. The clear pockets 11 are formed from clear strips 8 made from vinyl, plastic, or other material that provides sufficient transparency to display and view the items held underneath. Items are held in place in the pockets 11 by frictional engagement with the clear pockets 11 and the backing 13. Items may be easily added, removed, rearranged or reconfigured as desired, and to facilitate organization during seasonal events and times (such as, for example, during the Christmas holiday season) when items may be arriving frequently and at various intervals. The apparatus 10 is constructed to roll or fold to store neatly away when not in use. Non-seasonal variations may also be suitable for everyday organization of cards, photos, and documents.

Photos and documents can be easily added and removed without having to remove, disassemble and reassemble the apparatus 10. Items can be heavily loaded and overlapped into the display pockets 11 while still maintaining a secure, organized and streamlined appearance, thereby accommodating changes in the number of items being displayed.

In a first preferred embodiment, as shown in FIGS. 1A and 1B, the apparatus 10 comprises a flexible backing 13 that may be either folded or rolled for storage. In a preferred embodiment, the flexible backing 13 is made of printable styrene. On a front side 16 of the backing 13, the flexible backing 13 includes several clear vinyl sheets 8 that are fixedly that serve as pockets 11 for displaying items. Each pocket 11 is sealed to the front 16 of the flexible backing using any of sewn, stamped, glued, stapled, thermally fused, welded or other similar and well known methods for attaching vinyl and styrene along edges. Each pocket 11 is fixedly attached to the front 16 of the flexible backing 13 along both sides and a lower edge to form the pocket 11. To accommodate items larger than the height of an individual pocket 11, one pocket 17 has a lower edge 18 that is not fixedly attached to the front surface 16 of the backing 13 to allow larger items to be placed behind two clear vinyl strips 8 rather than just one.

As illustrated in FIG. 1B, a back 14 of the flexible backing 13 includes magnetic strips 15 that allow the apparatus 10 to be removably attached to a paramagnetic surface, such as a refrigerator door. The magnetic strips 15 are strategically placed to cause the backing 13 to lay flat against the surface to which it is attached. In addition, the strategic placement of the magnetic strips 15 likewise serves to cause the backing 13 to readily fold in a specific manner for easy storage.

The five magnetic strips are strategically placed on the back surface of the backing such that one magnetic strip is placed at the top of the backing; one magnetic strip is placed at the bottom of the backing; one magnetic strip is placed in the middle of the backing; one magnetic strip is placed one section above the bottom magnetic strip; and one magnetic strip is placed one section below the top magnetic strip.

Figure 2:
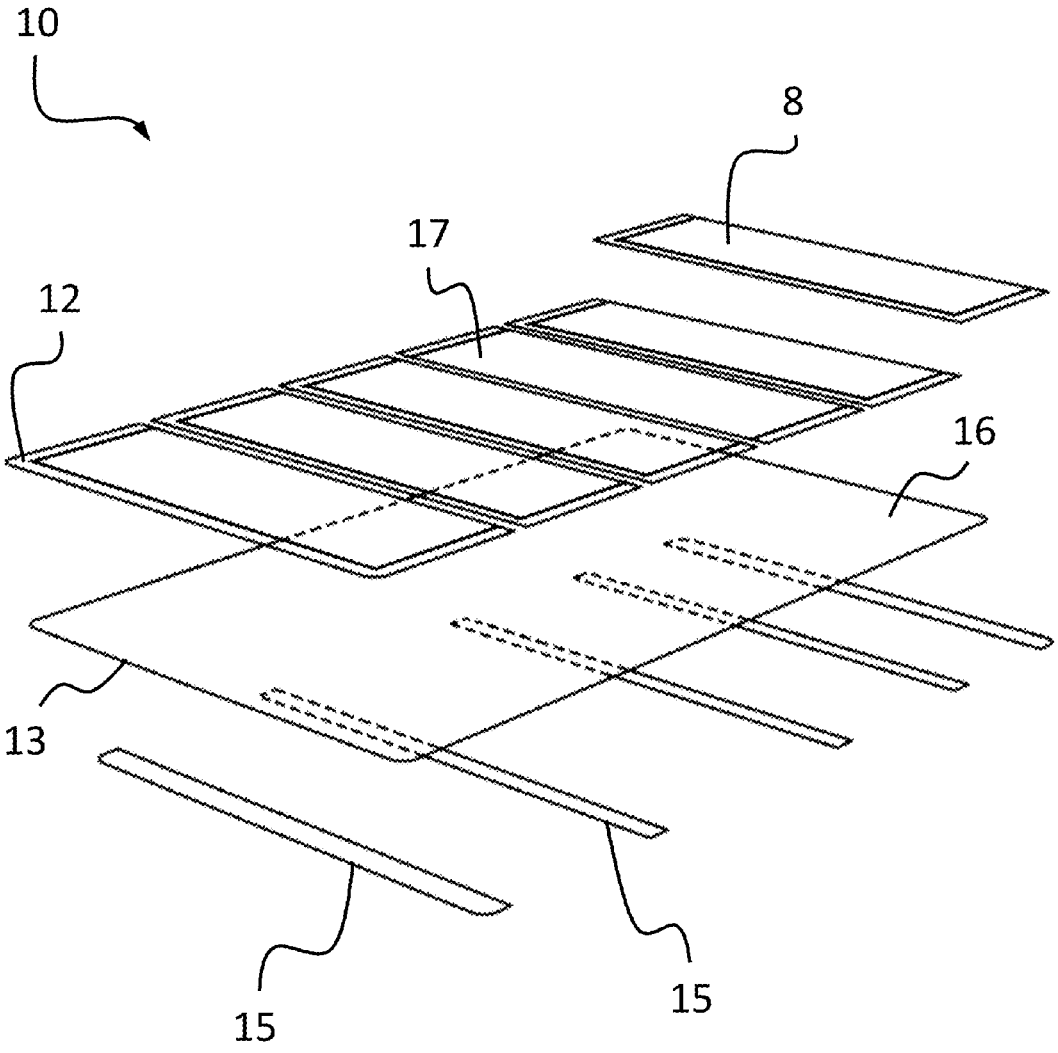
FIG. 2 is an exploded view of the apparatus of FIGS. 1A and 1B, in perspective.

Referring now to FIG. 2, an exploded perspective view of the apparatus 10 illustrates the assembly of the apparatus 10. The current version is shown as having six pockets 11. The apparatus 10 may be scaled up or down to accommodate fewer or a greater number of pockets 11 to accommodate the surface area to be covered. In addition, the pockets 11 may be scaled in size to accommodate smaller or larger items as desired. For the preferred embodiment, the pockets 11 are sized to receive items generally the size of a Christmas photo card.

Each of the pockets 11 are typically sealed at their lower edges and sides 12 to the backing 13. However, different versions may be provided where one or more pockets 17 do not have their lower edges 18 sealed, thereby allowing larger items to be displayed in more than one pocket 11.

The backing 13 is sized to accommodate the pockets 11 and the surface to which the apparatus 10 is to be adhered, such as a refrigerator door. The magnetic strips 15 are disposed transversely at strategic locations along the length of the backing 13 such that the apparatus 10 readily folds into a compact state for storage upon removal from the surface.

In an embodiment, one horizontal clear vinyl pocket 17 can be fused only at the sides to allow larger items to be placed behind two clear vinyl pockets 11. This would allow a user to display larger items such as children's school papers and artwork.

In addition, the ability to print an image on the front 16 of the backing 13 allows the apparatus 10 to provide a decorative function even before any photos are stored. In one embodiment, each of the pockets 11 would have a separate image or seen printed on the underlying surface such that pockets 11 could be filled, while unfilled pockets 11 still display an attractive image or design that does not appear cutoff. Images can include a decorative image and/or calendars and other useful key information, making the display gallery apparatus attractive and useful even before beginning to fill the pockets 11 with items.

In use, one would simply place the apparatus 10 on a metallic surface and display photos, documents, or other items under the clear vinyl pockets 11. The apparatus 10 can then be easily removed and stored for future use.

As further shown in FIG. 2, the gallery display apparatus 10 comprises a backing having a front surface and a back surface wherein the backing is divided in six substantially equal sections; six clear vinyl sheets for forming six transverse pockets on the front surface of the backing wherein the six clear vinyl sheets are fixedly transversely attached to the front surface of the backing, wherein one of the six transverse pockets is a bottom pocket; and five magnetic strips fixedly and transversely attached to the back surface of the backing, the magnetic strips for adhering the backing to a surface disposed in a generally vertical plane. The clear sheets are fixedly attached by any of sewing, gluing, fusing, fusing with heat, heat staking, sonic welding, and stamping.

Figure 3:
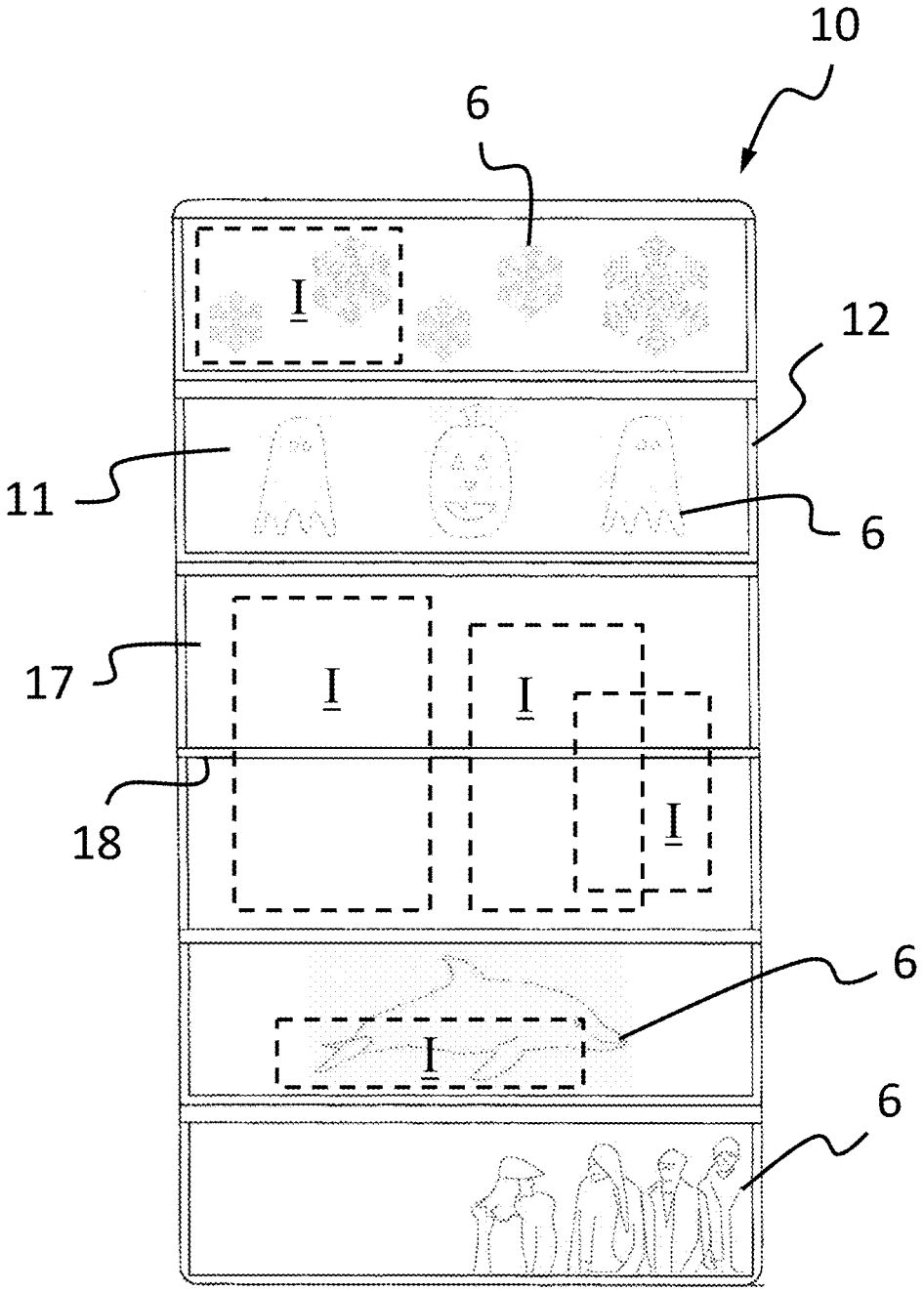
FIG. 3 is a front elevated view of the apparatus with various items stored in pockets.

Referring to FIG. 3, a front view of the apparatus 10 displaying a plurality of items I of different sizes is shown. In use, although the pockets 11 are essentially the same size, items I of differing sizes may be displayed in the pockets 11. For example, in unsealed pocket 17, larger items I may be displayed behind two pockets 11 wherein one pocket 17 does not have its lower edge 18 sealed.

Although shown as having six sections, the various embodiments can include more or less sections. For example, one version could consist of three or more clear sheets 8 for forming three or more transverse pockets 11 on the front surface; the three or more clear sheets 8 fixedly attached to the front surface 16 of the backing 13; and two or more magnetic strips 15 for adhering the backing 13 to a surface disposed in a generally vertical plane, the two or more magnetic strips 15 being generally thin and fixedly transversely attached to the back surface 14 of the backing.

As further shown in FIG. 3, the gallery display apparatus 10 may be configured such that images 6 correspond to the size of each of the pockets 11. Additionally, the gallery display apparatus 10 can be configured such that one or more of the six pockets 11, excluding the bottom pocket 11, has a lower edge that is not fixedly attached to the backing 13, thereby allowing items of different sizes to be displayed.

Figure 4:
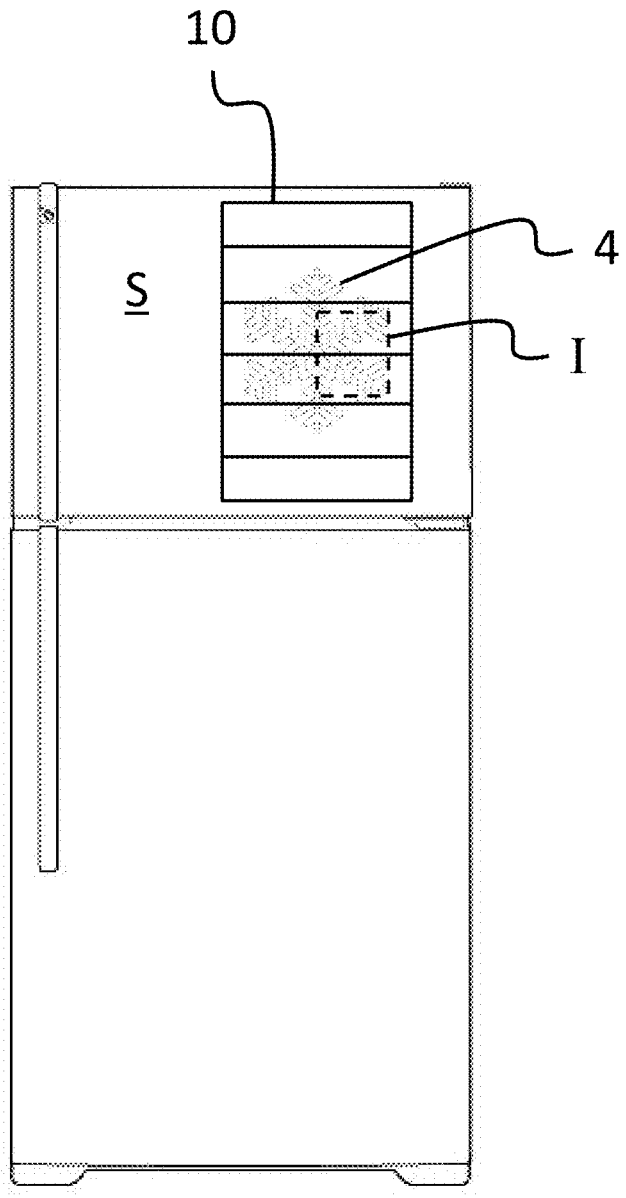
FIG. 4 is a view of the apparatus in use and applied to the front of a refrigerator.

FIG. 4 provides an illustration of the apparatus 10 in use displaying one item I and adhered to the surface S of the freezer door of one type of refrigerator. The apparatus 10 can be sized to readily accommodate the lower refrigerator door, or, doors of other types of refrigerators having different size surface areas.

Figure 5:
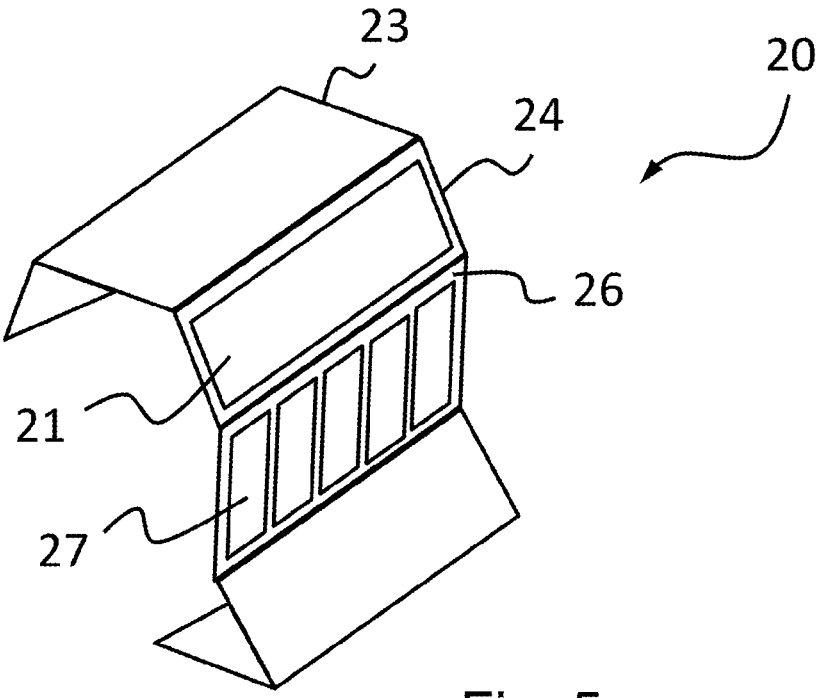
FIG. 5 is perspective view of the apparatus positioned for folding.

Referring now to FIG. 5, another embodiment 20 is comprised of a magnetic sheet 23 configured to stow much like a foldable game board. Hence, the magnetic sheet 23 is cut or seamed into multiple panels 24 to support folding. The magnetic sheet 23 is likewise created with dimensions intended to cover prominent areas of useable space of most common standard refrigerator doors. The front 26 of each panel 24 of the magnetic sheet 23 is covered with a combination of horizontally and/or vertically oriented strips 8 of clear vinyl, wherein the vinyl strips 8 are permanently fused at the edges with a top opening to form horizontal pockets 21 and a side opening for vertical pockets 27.

As with other embodiments, in use, the foldable magnetic sheet 23 adheres magnetically to the surface S of one's refrigerator door or any desired metallic surface. For ornamental purposes, the front of the sheet may be printed with a seasonal image, attractive color or pattern. As with other embodiments, the front 24 of each panel of the foldable sheet is covered side-to-side and top to bottom with clear vinyl strips 8 that act as pockets 21, 27 to conveniently place photos, cards, or documents into for display.

The magnetic sheet 23 is cut to size to accommodate reasonably viewable areas of popular standard refrigerator doors. The magnetic sheet 23 may be screen-printed. Clear vinyl sheeting 8 is cut to size to fit the magnetic sheet 23 side to side and with height adequate to cover the common width of a photo greeting card to form a pocket 21. The clear vinyl strips 8 are permanently adhered or fused, as plastics can be, at the edges of the clear vinyl strips 8 (on three sides), to the magnetic sheet 23, creating rows of clear pockets 21 that cover the entirety of the magnetic sheet 23.

The magnetic sheet 23 may be flexible or rigid and constructed to be multi-folded (like a game board) and conveniently stored. The configuration of the clear vinyl pockets 21 may be subject to change in construction, to create horizontal 21 and/or vertical pockets 27. The size of the clear vinyl pockets 21 may also be subject to change to accommodate other sizes of documents, for example, 8.5× 11's or even larger for children's artwork, etc. The viewable front surface 24 may be printed (or not) with seasonal or everyday images, colors or patterns.

Figure 6:
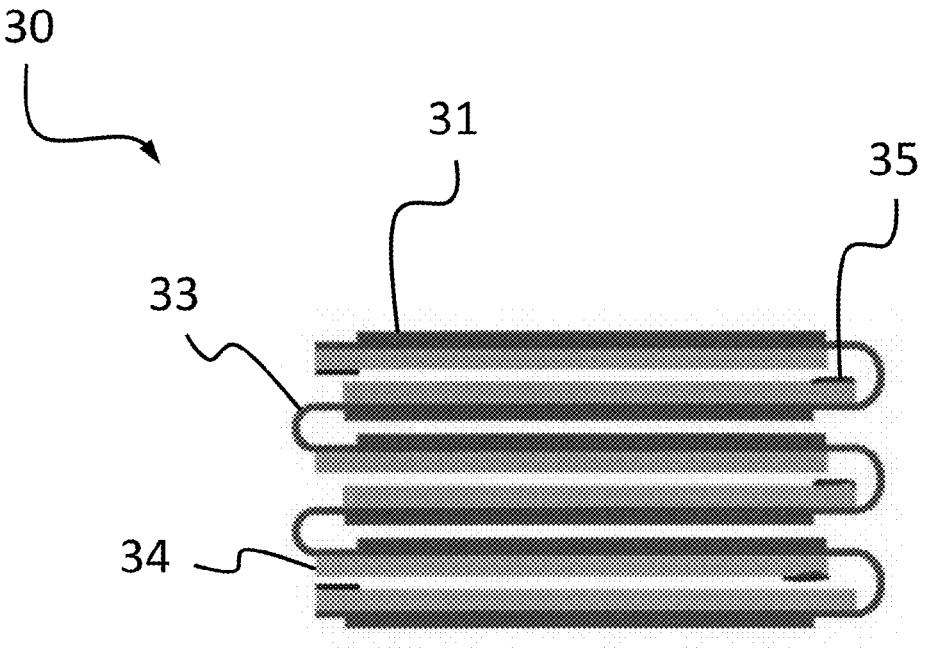
FIG. 6 is a side view of an alternative embodiment of the apparatus in a folded state.

Referring now to FIG. 6, a side elevation view of an alternative embodiment 30 is shown in a folded state. The flexible backing 33 is adhered to individual rigid boards 34. The pockets 32 are attached to the flexible backing 33. Separate magnetic strips 35 are adhered to each rigid board 34.

Although the various embodiments are shown herein as using magnetic attachment means, the apparatus 10 can likewise be configured to adhere to non-metallic surfaces via low-tack adhesive strips or to carpeted cubicle surfaces via hook-side Velcro. Additionally, although the various embodiments are shown herein as comprised of six panels, the apparatus 10 can be formed from two or more panels as appropriate to fit the area of the surface to which it is to be adhered.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element, which is not specifically disclosed herein.

I claim:

1. A gallery display apparatus for displaying greeting cards, photographs, photo cards, postcards, documents and other such planar items, comprising:

a. six panels having a front surface and a back surface;

b. a flexible backing attached to the front surface of each of the six panels;

c. six clear sheets for forming six pockets on a front of the flexible backing attached to the front surface of the six panels; and d. five magnetic strips attached to the back surface of five of the six panels for easily and rapidly adhering the entire gallery display apparatus to a surface disposed in a generally vertical plane, and for easily and rapidly removing and folding the gallery display apparatus with its contents still contained in the pockets, the five magnetic strips being generally thin and transversely attached to the back surface of five of the six panels such that when folded for storage, the magnetic strips cause the gallery display apparatus to remain in a closed position such that the displayed items are securely held in the gallery display apparatus when folded as well as when displayed on a surface.

2. A gallery display apparatus, comprising:

a plurality of panels having a front surface and a back surface;

a flexible backing attached to the front surface of each of the panels;

a plurality of clear sheets for forming a plurality of pockets on a front of the flexible backing attached to the front surface of the panels; and magnetic strips transversely attached to the back surface of some of the panels adhering the entire gallery display apparatus to a surface disposed in a generally vertical plane, and for removing and folding the gallery display apparatus with its contents still contained in the pockets, when folded for storage, the magnetic strips cause the gallery display apparatus to remain in a closed position such that the displayed items are securely held in the gallery display apparatus when folded as well as when displayed on a surface.

* * * * *